United States Patent [19]

Krapf

[11] Patent Number: 4,835,662

[45] Date of Patent: May 30, 1989

[54] LIGHT ASSEMBLY FOR A SMOKESTACK OR THE LIKE

[75] Inventor: Michael A. Krapf, Butter, Pa.

[73] Assignee: International Chimney Corporation, Buffalo, N.Y.

[21] Appl. No.: 148,644

[22] Filed: Jan. 26, 1988

[51] Int. Cl.[4] ..... F21S 1/02

[52] U.S. Cl. ..... 362/145; 362/287; 362/285; 362/370; 362/430

[58] Field of Search ..... 362/370, 285, 287, 419, 362/427, 430, 145

[56] References Cited

U.S. PATENT DOCUMENTS 2,358,014 9/1944 Lamb ..... 362/145

3,229,945 1/1966 Hartman ..... 362/427

*Primary Examiner*—Ira S. Lazarus

*Assistant Examiner*—Sue Hagarman

*Attorney, Agent, or Firm*—Christel, Bean & Linihan

[57] ABSTRACT

A light assembly for illuminating an industrial smokestack or the like having a ladder attached thereto utilizes an obstruction light and an elongated member having one end which is pivotally connected to the outside surface of the smokestack and another end which supports the obstruction light. The elongated member is pivotally movable between a first condition at which the other end of the elongated member is positioned remote of the ladder and a second condition at which the other elongated member end is positioned adjacent the ladder. The assembly further includes a rod member having one end which is pivotally connected to the elongated member and another end which is positionable adjacent the ladder so as to be accessible to a serviceman standing upon the platform. By selectively pulling or pushing upon the rod member, the serviceman moves the elongated member between the first condition and the second condition at which the light is accessible for servicing purposes.

14 Claims, 2 Drawing Sheets

Fig. 1.
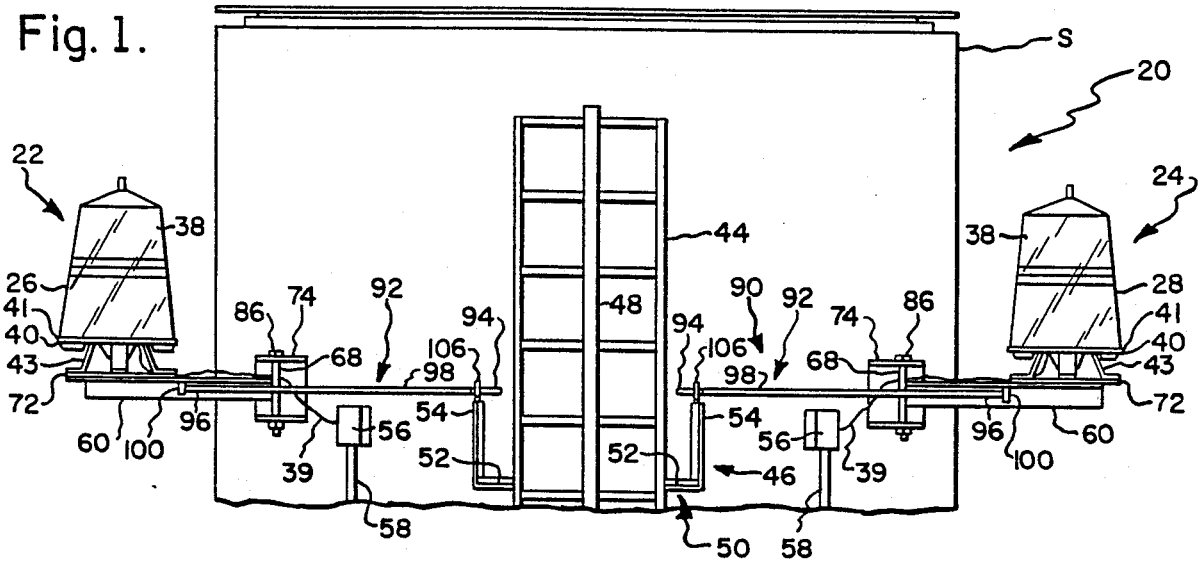
Fig. 3.
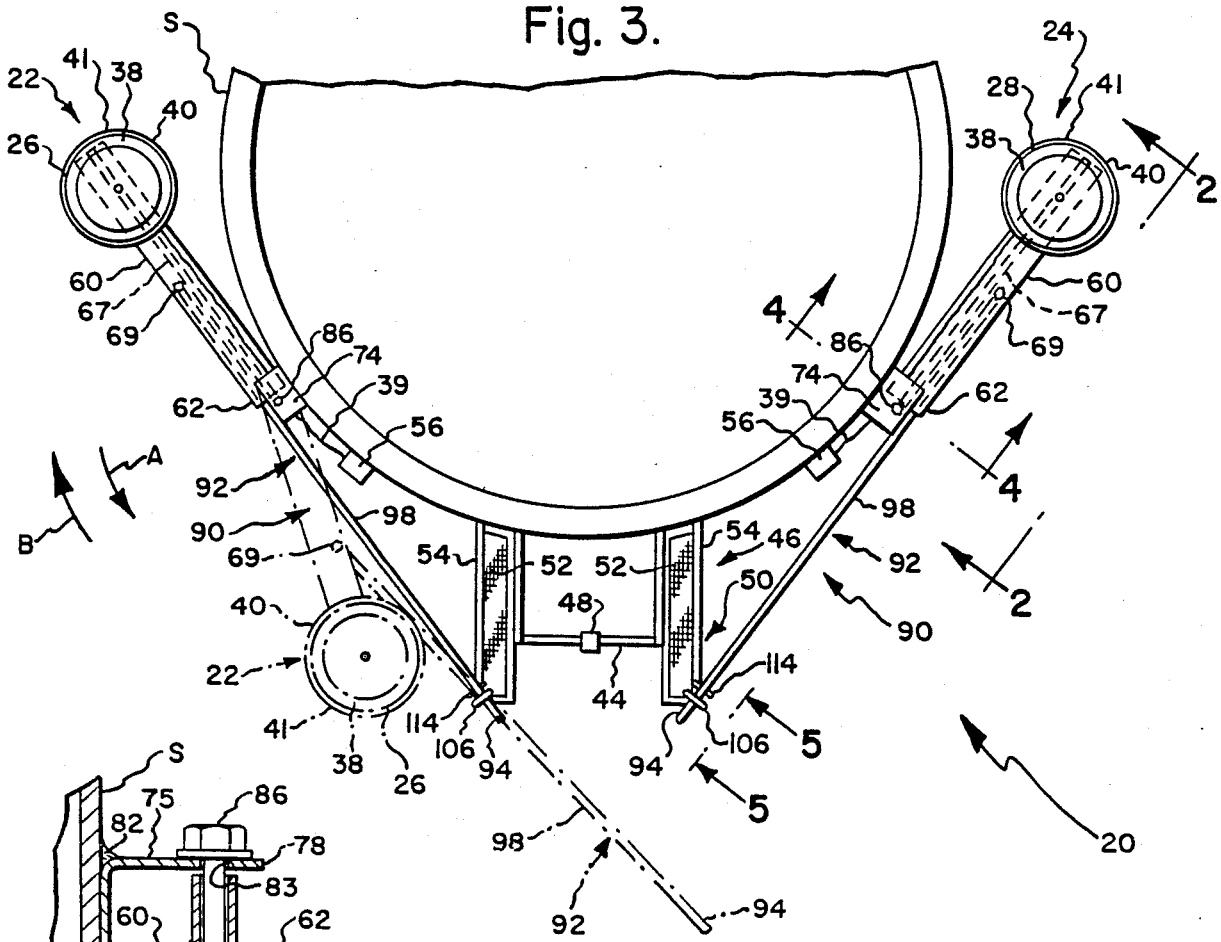
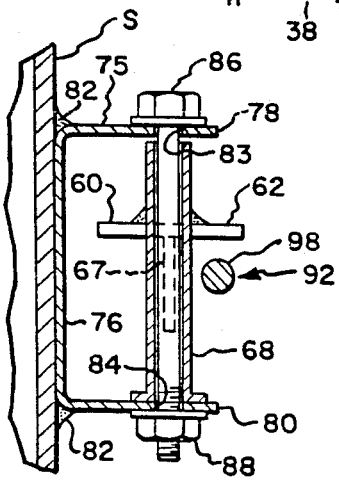
Fig. 4.

Fig. 5.
Fig. 2.
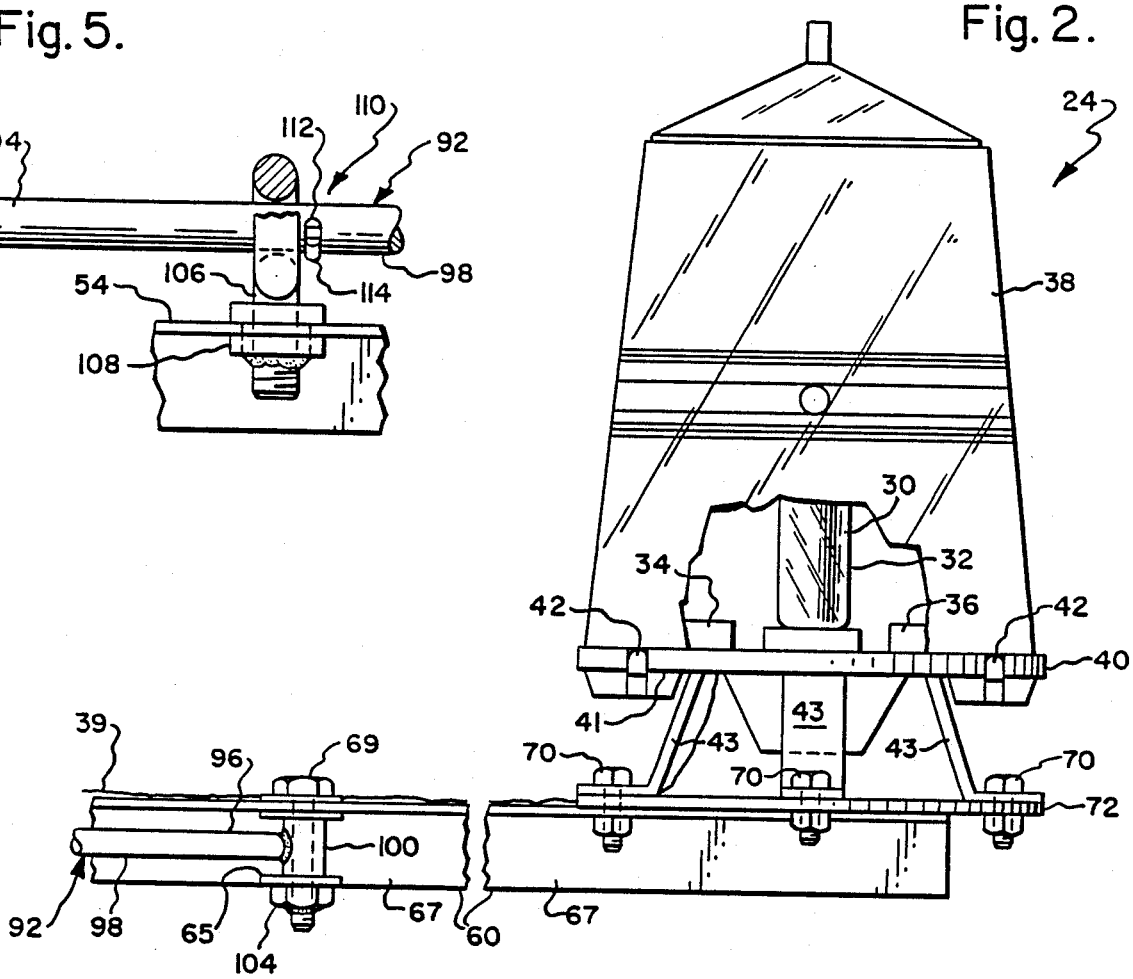
Fig. 6.
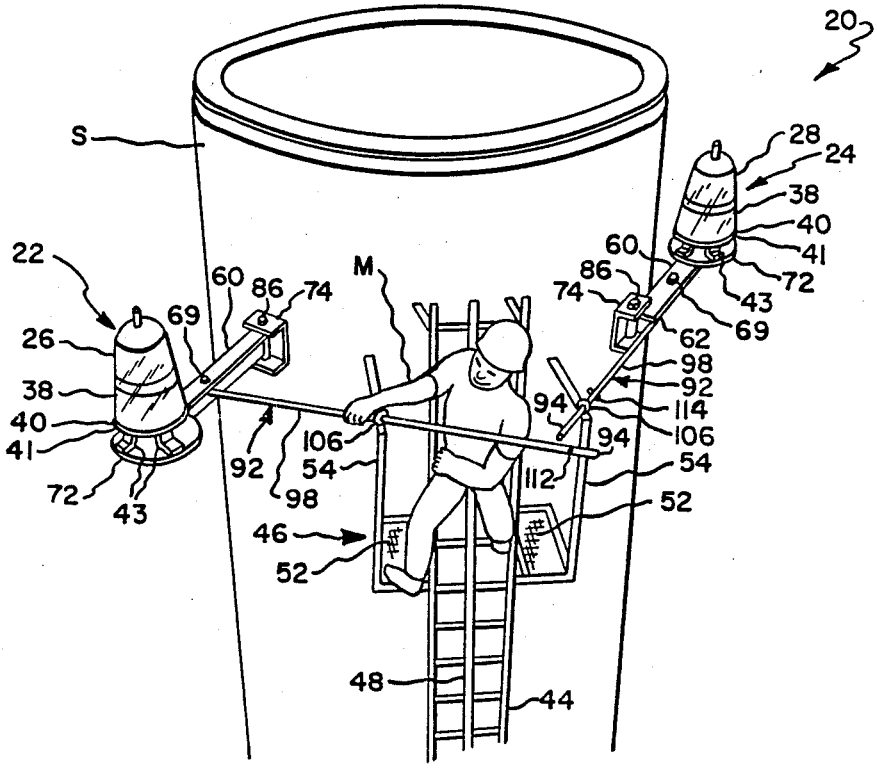

LIGHT ASSEMBLY FOR A SMOKESTACK OR THE LIKE

BACKGROUND OF THE INVENTION

This invention relates generally to lighting assemblies and relates more particularly to lighting assemblies associated with industrial smokestacks or chimneys.

The type of lighting assemblies with which this invention is to be compared includes lamps which are attached to the outside surface of an industrial smokestack or chimney and which are elevated from ground level to enhance the visibility of the smokestack or chimney. Such lamps may be necessary for the smokestack to be visible at all at night and may be required to satisfy various safety requirements.

Commonly, the lamps of each such assembly are arranged in a ring around the outside surface of the smokestack or chimney so that at least one of the lamps can be viewed by an observer from any location around the stack or chimney. For purposes of servicing the lamps in the assembly, a platform is affixed to the side of the stack or chimney so as to extend therearound and is situated in such a relationship with the light assembly that the lamps thereof are accessible to a serviceman standing upon the platform. Typically, a ladder is attached to the side of the stack or chimney enabling the serviceman to gain access to the platform from a lower elevation such as, for example, ground level.

A limitation associated with lighting assemblies of the aforedescribed type relates to the platform associated with the stack or chimney for servicing the lamps of the assemblies. More specifically, a platform which extends entirely around the outer surface of the stack is typically costly to construct so that the total cost involved in lighting the smokestack or chimney is relatively high. Furthermore, as a consequence of the necessity of a platform for servicing prior art lighting assemblies, the strenght of the chimney or stack must be sufficient to support such a platform. Hence, such strength must be factored into the design and construction of a stack and is believed to render a stack more costly to build than one not required to support such a platform.

Accordingly, it is an object of the present invention to provide a new and improved lighting assembly for attachment to the outer surface of a smokestack or chimney obviating the need for a service platform which extends completely around the stack or chimney.

Another object of the present invention is to provide such an assembly which can be serviced safely and with relative ease.

Still another object of the present invention is to provide such a lighting assembly which is relatively economical to construct and effective in operation.

SUMMARY OF THE INVENTION

This invention resides in a light assembly for illuminating a smokestack or the like having a ladder attached thereto.

The light assembly includes an elongated member, an obstruction light and a rod. The elongated member has two opposite ends wherein one end of the elongated member is connectable to the outside surface of the smokestack for pivotal movement of the other end of the elongated member between a first condition at which the other elongated member end is positioned remote of the ladder and a second condition at which the other elongated member end is positioned adjacent the ladder. The obstruction light is supportedly attached to the other end of the elongated member for movement therewith between the first and second conditions. The rod has one end which is pivotally connected to the elongated member and another end which is positionable adjacent the ladder so as to be accessible to a serviceman standing at the ladder. As the serviceman pulls the rod, the other end of the elongated member is moved from the first condition toward the second condition to thereby render the light accessible to the serviceman, and as the serviceman pushes the rod, the other elongated member end is moved from the second condition toward the first condition to thereby position the light in its operative, smokestack-illuminating condition.

BRIEF DESCRIPTION OF THE DRAWINGS

FIG. 1 is a side elevation view of a pair of light assemblies in accordance with the present invention shown operatively mounted upon a smokestack.

FIG. 2 is a fragmentary elevational view of a portion of one of the FIG. 1 light assemblies as seen generally from the right in FIG. 1 and shown partially cut-away.

FIG. 3 is a fragmentary plan view of the FIG. 1 light assemblies and smokestack as seen from above in FIG. 1.

FIG. 4 is a cross-sectional view taken about on line 4—4 of FIG. 3.

FIG. 5 is a cross-sectional view taken about on line 5—5 of FIG. 3 having a portion cut-away.

FIG. 6 is a perspective view of the FIG. 1 light assemblies wherein one of the light assemblies is being moved to a condition for servicing.

DETAILED DESCRIPTION OF THE ILLUSTRATED EMBODIMENTS

Turning now to the drawings in greater detail and considering first FIG. 1, there is shown a light system, generally indicated 20, including a pair of light assemblies 22, 24 in accordance with the present invention and shown operatively associated with an industrial smokestack, generally indicated S. The light assemblies 22, 24 include illumination means in the form of two obstruction lights 26, 28, respectively, for enhancing the visibility of the smokestack S by day or night. As best shown in FIG. 1, the obstruction lights 26, 28 are operatively positionable on opposite sides of the smokestack S so that at least one of the lights 26 or 28 is visible to an observer who looks generally toward the smokestack S from any location therearound.

With reference to FIG. 2, each obstruction light 26 or 28 includes an electric lamp or bulb 30 in the form of a Zeon flashtube 32 and associated components, such as a trigger transformer 34 and flash choke 36 which render the light 26 or 28 operable as a strobe light. While each light 26 or 28 operates as a strobe light whose components are connected together in a manner which is well known in the art, it will be understood that the principles of this invention can be variously applied to other known types of obstruction lights such as those including an incadescent bulb. Each light 26 or 28 further includes a globe 38 positioned about the tube 32 and a mounting base 40 upon which the tube 32 and globe 38 are operatively supported. Current is supplied to the tube 32 by means of a wire 39 having an end which extends through the base 40 and is operatively wired to the tube 32. Further, the base 40 includes a platform portion 41 upon which the globe 38 is releasably secured by means of fasteners 42,42 and includes a plurality of legs 43,43 for supporting the platform portion 41 in a generally horizontal orientation.

Occasionally, it becomes necessary to service one or both of the obstruction lights 26 or 28. Such servicing may involve either the replacement of one or more of the components 32,34 or 36 of the light 26 or 28 or a cleaning of the outer surface of the globe 38. To enable a serviceman M (FIG. 6) to gain access to the elevation of the lights 26,28, there is provided a ladder 44 (FIGS. 1 and 6) fixedly attached to the side of the smokestack S in a vertical orientation and an access platform 46 fixed to the smokestack S adjacent the upper end of the ladder 44. Extending vertically along the center of the rungs of the ladder 44 and as best shown in FIG. 1 is a safety climb 48 to which the safety belt of a serviceman M (FIG. 6) is secured during the course of his climb up and down the ladder 44.

With reference again to FIG. 1, the platform 46 includes framework 48 fixedly attached to the side of the smokestack S and a floor 50 of relatively small area supportedly attached to the framework 48. The floor 50 includes a pair of coplanar, relatively narrow footboards 52,52 positioned on opposite sides of the ladder 44 and which are bolted or welded to the framework 48. As best shown in FIG. 3 each footboard 52 or 52 extends generally away from the outside surface of the smokestack S. The framework 48 further includes a pair of horizontally-arranged safety handrails 54,54 which are each fixed in position about three to four feet above the floor 50.

The platform floor 50 is arranged in such a relationship with the lights 26,28 that a serviceman M (FIG. 6) standing upon the platform floor 50 is able to service either of the lights 26 or 28 in a manner described herein. As best shown in FIG. 3, the platform floor 50 is positioned substantially midway between the lights 26,28 as a path is traced around the circumference of the stack from one light 26 to the other light 28, and as best shown in FIG. 1 the floor 50 is arranged a few feet below the elevation of the lights 26 and 28 so that the horizontally-arranged handrails 54,54 are oriented at about the same elevation as the lights 26,28.

In accordance with the present invention and with reference to FIGS. 1–3, each light 26 or 28 of the light assembly 22 or 24 is accessible to a serviceman standing on the platform floor 50. To this end, each light assembly 22 or 24 includes means defining an elongated linkage member 60 operatively joining a corresponding light 26 or 28 to the surface of the smokestack S and which is movable between a condition as illustrated in solid lines in FIG. 3 at which the light 26 or 28 is positioned remote of the platform 46 and a condition such as illustrated by the light 26 in phantom in FIG. 3, at which the light 26 or 28 is positioned adjacent the polatform 50. As best shown in FIG. 3, each linkage member 60 defines two opposite end portions 62,64, one end portion 62 being pivotally connected to the outside surface of the smokestack S and the other end portion 64 adapted to support the corresponding light 26 or 28.

As best shown in FIGS. 1 and 2, each linkage member 60 is T-shaped in cross section with the lowermost leg, indicated 67, of the T arranged generally vertically as shown. Each member 60 is constructed of steel and further includes a lug 65 attached as with a weld to the member leg 67 as best shown in FIG. 2. The lug 65 is positioned substantially midway between the member ends 62,64 and defines an opening therethrough. The member 60 further defines an opening which is aligned with the opening of the lug 65. As is described herein, the aforedescribed aligned lug and member openings receive the shank of a bolt 69. Each member 60 further includes a sleeve-like member 68 fixedly secured and braced in position at the member end 62. The sleeve-like member 68 defines a central opening therethrough and as best shown in FIG. 4 is oriented generally parallel to the member leg 67.

With reference again to FIG. 2, each light assembly 22 or 24 includes a mounting plate 72 attached atop the linkage member end 64. Each mounting plate 72 is arranged in a horizontal orientation across the upper surface of its correponding linkage member 60 as shown in FIG. 2 and fixed thereto with bolts 70. The base 40 of the corresponding light 26 or 28 is, in turn, operatively positioned upon the mounting plate 72 and secured thereto by the bolts 70 having shanks which extend through aligned apertures in the legs 43 of the base 40 and mounting plate 72.

With reference again to FIGS. 1 and 4, and to effect the pivotal joinder between the linkage member end portions 62 and the outside surface of the smokestack S, each light assembly 22 or 24 includes a mounting bracket 74 fixedly attached to a corresponding side of the smokestack S. Each mounting bracket 74 is generally U-shaped in cross section so as to define a plate-like base portion 76 and two plate-like leg portions 78,80 joined to so as to extend generally from the base portion 76. The leg portions 78,80 are arranged in parallel relation and the base portion 76 is fixedly secured, as with welds 82, to the outside surface of the smokestack S.

Furthermore and with reference still to FIG. 4, the base portion 76 is arranged against the smokestack surface so that the leg portions 78,80 are arranged generally horizontally and the leg portion 78 is positioned above the leg portion 80. Still further, the leg portions 78,80 define aligned apertures 83,84 wherein the centerline of the aligned apertures 83,84 is oriented generally vertically. Yet still further and as best shown in FIG. 3, each mounting bracket 74 is attached to the surface of the smokestack S at a location relatively remote of the platform 50. More specifically, each bracket 74 is attached to the surface of the smokestack at a location situated about midway between the platform 50 and the location situated around the circumference of the smokestack S at which the light 26 or 28 is desired to be positioned when operating.

With reference still to FIG. 4, the sleeve-like member 68 of each linkage member 60 is operatively positioned between the leg portion 78 and 80 of a corresponding bracket 74 and arranged therebetween so that the central opening of the sleeve-like member 68 is aligned with the leg portion apertures 83 and 84. A bolt 86 having an elongated shank is positioned through the aligned apertures 83,84 and sleeve-like member 68 to join the sleeve-like member 68 to and permit the sleeve-like member 68 to rotate about the shank of the bolt 86. Accordingly, the diameter of the shank of the bolt 82 is slightly smaller than that of the through-opening of the sleeve-like member 68. A nut 88 is threaded upon and welded in place upon the end of the bolt 86 opposite the head end thereof so that the bolt 86 is prevented from being withdrawn from the braket 74.

It follows from the foregoing that each linkage member 60 is pivotally connected to the outside surface of the smokestack S by means of the corresponding mounting bracket 74 and bolt 86 for pivotal movement relative to the smokestack S in the direction of the arrow A or B in FIG. 3 along a generally horizontal path between one condition and another condition. More specifically and as exemplified by the light 26 and associated linkage member 60 of FIG. 3, each linkage member 60 is pivotally movable relative to the smokestack S between a first condition as illustrated in solid lines in FIG. 3 at which the corresponding light 26 or 28 is positioned remote of the platform 50 and a second condition as illustrated in phantom in FIG. 3 at which the corresponding light 26 or 28 is positioned generally adjacent the platform 50.

As mentioned earlier, current is supplied to the flashtube 32 by means of a wire 39. As best illustrated in FIGS. 1 and 2, the wire 39 is routed from the base 40 of the corresponding light 26 or 28, along the linkage member 60 to a junction box 56 mounted against the outside surface of the smokestack S and adjacent the bracket 74. Current is, in turn, supplied to each junction box 56 by means of wires housed within a conduit 58 extending between each junction box 56 and a power source located, for example, at ground level.

With reference to FIGS. 2, 3 and 5, each light assembly 22 or 24 further includes means, generally indicated 90, for moving the linkage member 60 between the aforesaid remote and adjacent conditions. In each of the light assembly 22 or 24, the moving means 90 includes an elongated, generally straight rod member 92 operatively joined to the linkage member 62 so that the serviceman M (FIG. 6) standing upon the platform 50 can manually pivot the linkage member 60 about the bolt 86. Each rod member 92 defines two opposite end portions 94,96 which are each associated with a corresponding one of the linkage members 60 and a handrail 54 of the platform framework 48. Each rod member 94 or 96 includes a steel rod 98 and a bushing portion 100 (FIG. 2) attached to the end of the rod 98 corresponding to the rod member end portion 96. The bushing portion 100 defines a through-opening having cylindrical walls and, as best shown in FIG. 2, is positioned in abutting relationship with an end of the rod 92 and welded thereto so that the central axis of the bushing portion through-opening is oriented generally perpendicular to the longitudinal axis of the rod 92.

With reference still to FIG. 2, the bushing portion 100 of the rod member 92 is positioned in such a relationship with the linkage member 62 and lug 68 associated therewith so that the bushing portion through-opening is aligned with the aligned openings of the lug 65 and member 60. The shank of the bolt 69 introduced earlier, is operatively positioned through the aforedescribed aligned openings in the lug 65 and member 60, and a nut 104 is threaded and welded in place upon the end of the bolt 69 to thereby prevent withdrawal of the bolt 69 from the linkage member 60 and bushing portion 100. It follows from the foregoing that each rod member 92 is operatively secured to a corresponding one of the linkage members 60,60 by means of the bolt 69. The bolt 69 further accommodates a pivoting of the rod member 90 relative to the linkage member 60 along a path of movement which is confined to a generally horizontal plane. Accordingly, the shank of the bolt 69 is slightly smaller in diameter than that of the through-opening of the bushing portion 100.

With reference to FIGS. 1 and 5, a portion of the weight of each rod member 92 is supported by the handrails 54 of the platform framework 48. To this end, there is attached to each handrail 54 an eyebolt 106 having a shank which extends through an aperture in the handrail 54 and which is fixedly secured thereto by means of a nut 108 threaded and welded in place upon the eyebolt shank. The eyebolt 106 defines an eye through which the rod 92 of the rod member 90 is received so that the rod 92 can be slidably moved endwise through the eye of the eyebolt 106 with relative ease.

When the linkage member 60 of each light assembly 22 or 24 is positioned in the FIG. 3 solid line condition, the corresponding light 26 or 28 is positioned in its farthest positioned from the platform 50 and the rod member end portion 94 is positioned in the eye of the eyebolt 106. Furthermore, and when in such a condition, the rod member 92 is arranged generally parallel to the corresponding linkage member 60. Accordingly, the length of each rod member 90 is at least as great as the sum of the distance as measured between the bolts 86 and 69 and the distance as measured between the bolt 86 and the eyebolt 106.

In accordance with the present invention and with reference to FIG. 5,, each light assembly 22 or 24 further includes means, generally indicated 110, for releasably maintaining the corresponding light 26 or 28 in its FIG. 3 solid-line condition. To this end, the rod 92 of each rod member 90 defines an opening 112 extending transversely of the rod 92 and the maintaining means 110 includes a key 114 for cooperating with the rod opening 112 to thereby releasably lock the key 114 to the rod 90. More specifically, the key 114 is in the form of a Cotter key having a shank portion cooperable with the rod opening 112 to releasably lock the key 114 about the rod 92 which is releasably received by the rod so that portions of the key 114 extend out of the hole 112 when the key 114 is operatively secured therein. When the light 26 or 28 is positioned in the FIG. 3 solid-line condition and as best shown in FIGS. 3 and 5, the hole 112 is defined in each rod 92 at the location therealong which is positioned in relatively close proximity to the eyebolt 106 and between the eyebolt 106 and rod end portion 96. Therefore, the portions of the key 114 which extend from the rod hole 112 provide stops for abutting the eyebolt 106 and for thereby limiting the movement of the rod 92 therethrough. It follows that by extracting the key 114 from the rod hole 112, the rod 92 can be freely moved longitudinally through the eyebolt 106 and by inserting the key 114 through the rod hole 112 when the light 26 or 28 is positioned in the FIG. 3 solid line condition, the light 26 or 28 is prevented from moving from its condition remote of the platform 50 toward its condition adjacent the platform 50.

To service the light 26 or 28 of a corresponding light assembly 22 or 24 and with reference to FIG. 6, a serviceman M climbs upon the platform 50 and plants his feet in a relatively secure position upon the footboards 52. The key 114 of the light assembly 22 or 24 desired to be serviced is then extracted or withdrawn from the hole 112 of the corresponding rod member 92. The serviceman M then manually pulls the rod member 92 to move the light 26 or 28 from the FIG. 3 solid-line condition to a position, exemplified by the light 26 and illustrated in phantom in FIG. 3, adjacent the platform 50. As the light 26 or 28 is moved as aforesaid, the rod member 92 is slidably moved relative to and through the eye of the eyebolt 106 and the linkage member 62 pivots about the bracket 74. Once positioned adjacent the platform 50, the light 26 or 28 is easily accessibly to the serviceman. Once the servicing of the light 26 or 28 is completed, the serviceman M returns the light 26 or 28 to the FIG. 3 solid-line condition by manually pushing upon the rod member 92 so that the rod member 92 slides longitudinally through the eyebolt 106 in the direction opposite the direction moved when pulled through the eyebolt 106. Upon moving the rod 92 through the eyebolt 106 to a position so that the rod opening 112 is positioned relative to the eyebolt 106 as shown in FIG. 5, the key 114 is replaced within the rod opening 112. It follows that the pivotal connection between the rod member 92 and the corresponding linkage member 62 accommodates the necessary movement therebetween as the light 26 or 28 is moved between the aforedescribed conditions remote and adjacent the platform 50.

An advantage provided by the light system 20 of the system 20 relates to the size of the platform necessary for servicing the lights 26 and 28. More specifically, and because the lights 26 and 28 can be serviced from a platform 50 having a relatively small area upon which the serviceman stands, any need for a platform which totally or partially encircles the smokestack S is obviated. Such an advantage can be readily appreciated when considering the relatively high cost involved in constructing a platform so as to encircle all or a portion of a smokestack S and the associated cost involved in constructing the smokestack S to support such an encircling platform.

Another advantage of the light system 20 relates to the relative safety with which a serviceman can service the lights 26 and 28. In this connection, and as mentioned earlier, a serviceman who desires to service one of the lights 26 or 28 normally climbs to the platform 50 with his safety belt operatively connected to the safety climb 48 (FIGS. 1 and 6). Once the serviceman climbs upon the platform 50, there is no need for the serviceman to disconnect his belt from the safety climb 48. Therefore, any risk of falling entailed when the serviceman disconnects his safety belt from the climb 48 for reattachment to a railing or other safety means normally associated with a platform which at least partially encircles a smokestack is obviated.

It will be understood that numerous modifications and substitutions can be had to the aforedescribed embodiment without departing from the spirit of the invention. Accordingly, the aforedescribed embodiment 20 has been shown and described for purposes of illustration and not as limitation.

What is claimed is:

1. A light assembly for use with an industrial smokestack of the type having a stack constructed about a generally vertically extending axis and a service ladder mounted to the outside surface of the smokestack in parallel relation to said axis, said assembly comprising:

means defining an elongated member, said member having two opposite ends means for pivotally connecting said elongated member at one end thereof to the outside surface of the smokestack for pivotal movement of said elongated member, said pivotal movement being in a perpendicular direction relative to said vertically extending axis of said smokestack such that said member is moved between a first condition at which the other end of the elongated member is positioned remote of the ladder and a second condition at which said other elongated member end is positioned adjoining the ladder;

means for supportively attaching an obstruction light to said other end of said elongated member; and a rod member having one end pivotally connected to said elongated member and another end being positionable adjacent the outside surface of the smokestack and adjoining the ladder so as to be accessible to a serviceman standing at the ladder so that as said rod member is pulled in a perpendicular direction relative to the vertically extending axis of said stack by the serviceman, the other end of the elongated member is moved from said first condition toward said second condition to thereby render said light accessible to the serviceman and so that as said rod member is pushed by the serviceman, the elongated member is moved from said second condition toward said first condition.

2. An assembly as defined in claim 1 further including bracket means adapted to be attached to the outside surface of a smokestack and said one end of said elongated member is pivotally attached to said bracket means so that when said bracket means is operatively attached to the smokestack, said elongated member is pivotally connected thereto.

3. An assembly as defined in claim 1 further comprising means associated with said rod member for releasably securing said light in said first condition.

4. A light system for illuminating a smokestack or the like having a ladder extending generally vertically along the outside surface thereof, said system comprising:

means defining a platform fixedly secured to the outside surface of the smokestack and including a floor positioned in relatively close proximity to the ladder, means defining an elongated member having two opposite ends and which is connected at one end to the outside surface of the smokestack for pivotal movement of said elongated member relative to said smokestack between a first condition at which the other end of the elongated member is positioned remote of the ladder and a second condition at which said other elongated member end is positioned adjacent the ladder;

an obstruction light supportedly attached to said other end of said elongated member; and a rod member having one end being pivotally connected to said elongated member and another end being positioned adjacent the ladder so as to be accessible to a serviceman standing upon the floor of the platform so that as said rod member is pulled by the serviceman, the other end of the elongated member is moved from said first condition to said second condition to thereby render said light accessible to the serviceman and so that as said rod member is pushed by the serviceman, the other elongated member end is moved from said second condition toward said first condition.

5. A light system as defined in claim 4 further including a bracket interposed between the outside surface of the smokestack and said one end of said elongated member, said bracket being fixedly attached to the outside surface of the smokestack and said one end of said elongated member is pivotally attached to said bracket to effect the pivotal attachment of said elongated member to said smokestack.

6. A light system as defined in claim 4 further comprising means for releasably securing said light in said first condition.

7. A light system as defined in claim 6 wherein said means for releasably securing includes means associated with said rod member and platform-defining means for preventing said rod member from slidably moving relative to said platform-defining means.

8. A light system as defined in claim 4 wherein said rod member is supported by said platform-defining means for sliding movement relative thereto as said rod member is pushed and pulled by the serviceman as aforesaid.

9. A light system as defined in claim 7 further comprising means for releasably securing said light in said first condition and said means for releasably securing includes means associated with said rod member and platform-defining means for preventing said rod member from slidably moving relative to said platform-defining means.

10. A light system as defined in claim 4 wherein said elongated member, said obstruction light and said rod member comprise a first light assembly operatively attached to the outside surface of the smokestack and positioned generally to one side of the ladder for illuminating one side of the smokestack and said system further includes a second light assembly operatively attached to the outside surface of the smokestack and positioned generally to the other side of the ladder for illuminating another side of the smokestack, said second light assembly including:

a second elongated member having two opposite ends and which is connected at one end to the outside surface of the smokestack for pivotal movement of the second elongated member relative to said smokestack between a first condition at which the other end of the second elongated member is positioned remote of the ladder and a second condition at which said other end of the second elongated member is positioned adjacent the ladder;

a second obstruction light supportedly attached to said other end of the second elongated member; and a second rod member having one end being pivotally connected to the second elongated member and another being positioned adjacent the ladder so as to be accessible to a serviceman standing upon the platform so that as said rod member is pulled by the serviceman, the other end of the second elongated member is moved from said first condition to said second condition to thereby render said second light accessible to the serviceman and so that as said rod member is pushed by the serviceman, the second light is moved from said second condition toward said first condition.

11. A light system for illuminating a smokestack or the like having a ladder attached to the outside surface of the smokestack, said system comprising:

an elongated member having two opposite end portions, one of said end portions being pivotally connected to the outside surface of the smokestack for pivotal movement of said elongated member about an axis of pivot;

illumination means including a light operatively supported by the other end portion of said elongated member;

platform-defining means fixedly secured to the smokestack and including a floor upon which a serviceman stands when servicing the illumination means, said floor being positioned adjacent the ladder and distally of the pivot axis of the linkage member as measured around the perimeter of the smokestack, said linkage member being movable along a generally horizontal path as said member is moved about said pivot axis so that said elongated member is movable between a first condition at which the light of said illumination means is operatively positioned remote of said floor for illuminating the smokestack and a second condition at which the light of said illumination means is positioned adjacent said floor and is thereby accessible to a serviceman standing upon said floor for servicing purposes; and a rod member having one end being pivotally connected to said elongated member and another end positioned so as to be accessible to a serviceman standing upon said floor so that by selectively pulling or pushing upon said rod member, said elongated member is pivoted about said pivot axis so that said illumination means is moved between said first and second conditions.

12. An assembly of claim 1, in combination with an industrial smokestack of the type having a stack constructed about a generally vertically extending axis.

13. A light assembly for use with a tall building structure of the type constructed about a generally vertically extending axis and a service ladder mounted to the outside surface of said building structure in parallel relation to said axis, said assembly comprising:

means defining an elongated member, said member having two opposite ends;

means for pivotally connecting said elongated member at one end thereof to the outside surface of said tall building structure for pivotal movement of said elongated member, said pivotal movement being in a perpendicular direction relative to said vertically extending axis of said building structure such that said elongated member is moved between a first condition at which the other end of said elongated member is positioned remote of the ladder and a second condition at which said other elongated member end is positioned adjoining the ladder;

means for supportively attaching an obstruction light to said other end of said elongated member; and a rod member having one end being pivotally connected to said elongated member and another end being positionable adjacent the outside surface of said building structure and adjoining said ladder so as to be accessible to a serviceman standing at the ladder so that as said rod member is pulled in a perpendicular direction relative to the vertically extending axis of said building structure by the serviceman, the other end of the elongated member is moved from said first condition toward said second condition to thereby render said light accessible to the serviceman and so that as said rod member is pushed by the serviceman, the elongated member is moved from said second condition toward said first condition.

14. An assembly as defined in claim 13, further including means defining a platform fixedly secured to the outside surface of the smokestack and including a floor positioned in relatively close proximity to the ladder, said another end of said rod member being accessible by a serviceman standing upon the floor of the platform.

* * * * *